US007889213B2

(12) United States Patent
Baek et al.

(10) Patent No.: US 7,889,213 B2
(45) Date of Patent: Feb. 15, 2011

(54) DISPLAY DEVICE INCLUDING PIXELS SHARING SUB-PIXELS AND DRIVING METHOD THEREOF

(75) Inventors: Heum-Il Baek, Seoul (KR); Jong-Jin Park, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1083 days.

(21) Appl. No.: 10/875,574

(22) Filed: Jun. 25, 2004

(65) Prior Publication Data

US 2005/0128224 A1 Jun. 16, 2005

(30) Foreign Application Priority Data

Dec. 13, 2003 (KR) ..... 10-2003-0090927

(51) Int. Cl.
*G09G 5/10* (2006.01)

(52) U.S. Cl. ..... 345/690; 345/691; 345/88

(58) Field of Classification Search ..... 345/690, 345/698, 694, 695, 696, 88, 22
See application file for complete search history.

(56) References Cited

U.S. PATENT DOCUMENTS 5,313,298 A * 5/1994 Meeker ..... 375/240.01
5,563,621 A * 10/1996 Silsby ..... 345/43
5,994,721 A * 11/1999 Zhong et al. ..... 257/89
6,271,821 B1 * 8/2001 Sung et al. ..... 345/98
6,717,650 B2 * 4/2004 Jain ..... 355/53
6,750,874 B1 * 6/2004 Kim ..... 345/600
6,924,819 B2 * 8/2005 Nishida et al. ..... 345/604
7,030,845 B2 * 4/2006 Maa ..... 345/88
7,697,012 B2 * 4/2010 Lee et al. ..... 345/613
2003/0218618 A1 * 11/2003 Phan ..... 345/629
2004/0212633 A1 * 10/2004 Natori et al. ..... 345/694

OTHER PUBLICATIONS

Baek-woon Lee, et al. "40.5L: Late-News Paper: TFT-LCD with RGBW Color System." *SID Digest*. 2003, pp. 1212-1215.

* cited by examiner

*Primary Examiner*—Quan-Zhen Wang
*Assistant Examiner*—Calvin C Ma
(74) *Attorney, Agent, or Firm*—Morgan, Lewis & Bockius LLP

(57) ABSTRACT

A display device includes a signal storing portion storing first, second, third, and fourth input data signals, an average signal generating portion averaging the first, second, third, and fourth input data signals, respectively, that are adjacent to each other along a row and a column and generating first, second, third, and fourth output data signals, and a display portion having a plurality of pixels, each of the pixels having first, second, third, and fourth sub-pixels for receiving the first, second, third, and fourth output data signals, respectively, and each of the pixels sharing the sub-pixels with an adjacent one of the pixels.

16 Claims, 7 Drawing Sheets

FIG. 5A
RELATED ART

| | | | | | |
|---|---|---|---|---|---|
| R (i-1, j-1) | G (i-1, j-1) | R (i-1, j) | G (i-1, j) | R (i-1, j+1) | G (i-1, j+1) |
| W (i-1, j-1) | B (i-1, j-1) | W (i-1, j) | B (i-1, j) | W (i-1, j+1) | B (i-1, j+1) |
| R (i, j-1) | G (i, j-1) | R (i, j) | G (i, j) | R (i, j+1) | G (i, j+1) |
| W (i, j-1) | B (i, j-1) | W (i, j) | B (i, j) | W (i, j+1) | B (i, j+1) |
| R (i+1, j-1) | G (i+1, j-1) | R (i+1, j) | G (i+1, j) | R (i+1, j+1) | G (i+1, j+1) |
| W (i+1, j-1) | B (i+1, j-1) | W (i+1, j) | B (i+1, j) | W (i+1, j+1) | B (i+1, j+1) |

FIG. 5B

| | | | |
|---|---|---|---|
| R' (i-1, j-1) | G' (i-1, j-1) | R' (i-1, j) | G' (i-1, j) |
| W' (i-1, j-1) | B' (i-1, j-1) | W' (i-1, j) | B' (i-1, j) |
| R' (i, j-1) | G' (i, j-1) | R' (i, j) | G' (i, j) |
| W' (i, j-1) | B' (i, j-1) | W' (i, j) | B' (i, j) |

DISPLAY DEVICE INCLUDING PIXELS SHARING SUB-PIXELS AND DRIVING METHOD THEREOF

The present invention claims the benefit of Korean Patent Application No. 2003-90927 filed in Korea on Dec. 13, 2003, which is hereby incorporated by reference.

BACKGROUND OF THE INVENTION

1. Field of the Invention

The present invention relates to a display device, and more particularly, to a quad-type display device having a pixel comprising red, green, blue, and white sub-pixels, and a driving method thereof.

2. Discussion of the Related Art

Until recently, display devices generally employed cathode-ray tubes (CRTs). Presently, many efforts are being made to study and develop various types of flat panel displays, such as liquid crystal display devices (LCDs), plasma display panel (PDPs), field emission displays, and electro-luminescence displays (ELDs), as substitutions for CRTs because of their high resolution images, lightness, thin profile, compact size, and low voltage power supply requirements. In addition, such a display device displays video information with a plurality of pixels arranged in a matrix type. In general, a pixel has red-color, green-color, and blue-color sub-pixels.

FIG. 1 is a view of a RGB-stripe-type display device according to the related art. In FIG. 1, a RGB-strip-type display device includes gate and data lines "GL" and "DL" crossing each other to define a sub-pixel region, such that red-color, green-color and blue-color sub-pixels, "R", "G", and "B," are arranged along a row line to constitute a pixel.

A display device also may be, instead of the RGB-stripe type, a RGB-delta-type or a RGB-mosaic-type. Further, a quad-type display device having red-color, green-color, blue-color, and white-color sub-pixels also has been used.

FIG. 2 is a view of a quad-type display device having red, green, blue, and white sub-pixels to the related art. In FIG. 2, red-color, green-color, blue-color, and white-color sub-pixels, "R", "G", "B", and "W," constitute a pixel "P". In addition, a plurality of pixels "P" are arranged in a matrix. Since the quad-type display device further has a white-color sub-pixel "W", the quad-type display device has a higher white luminance than the RGB-stripe-type display device.

However, the quad-type display device has a reduced aperture ratio, requires more data and gate lines, and needs more driving circuits. For example, if a display device has XGA resolution (1024×768), the RGB-stripe-type has sub-pixels of 1024×3 columns and 768 rows and the quad-type display device has sub-pixels of 1024×2 columns and 768×2 rows. Because the quad-type display has more sub-pixels than the RGB-stripe-type, an area of each of the sub-pixels of the quad-type display device is smaller than an area of each of the sub-pixels of the RGB-stripe-type display device. In addition, the quad-type display device needs 1024×4 data lines and 768×2 gate lines to drive the sub -pixels, while a RGB-stripe-type display device having XGA resolution has 1024×3 data lines and 768×2 gate lines. Accordingly, the quad-type display device needs more data and gate lines than the RGB-stripe-type display device, thereby needing more driving circuits.

SUMMARY OF THE INVENTION

Accordingly, the present invention is directed to a display device and a driving method thereof that substantially obviate one or more of problems due to limitations and disadvantages of the related art.

An object of the present invention is to provide a display device and a driving method thereof that prevent a reduction in aperture ratio and avoid an increase in numbers of data lines, gate lines and driving circuits.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the display device includes a signal storing portion storing first, second, third, and fourth input data signals, an average signal generating portion averaging the first, second, third, and fourth input data signals, respectively, that are adjacent to each other along a row and a column and generating first, second, third, and fourth output data signals, and a display portion having a plurality of pixels, each of the pixels having first, second, third, and fourth sub-pixels for receiving the first, second, third, and fourth output data signals, respectively, and each of the pixels sharing the sub-pixels with an adjacent one of the pixels.

In another aspect, the driving method of a display device includes storing first, second, third, and fourth input data signals, averaging the first, second, third, and fourth input data signals, respectively, that are adjacent to each other along a row and a column, and generating first, second, third, and fourth output data signal, and displaying images through a plurality of pixels, each of the pixels having first, second, third, and fourth sub -pixels for receiving the first, second, third, and fourth output data signals, respectively, and each of the pixels sharing the sub-pixels with an adjacent one of the pixels.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 5A is a view of a 9-pixel arrangement for the quad-type display device in FIG. 2 according to the related art;

FIG. 5B is a view of a 9-pixel arrangement according to an embodiment of the present invention;

DETAILED DESCRIPTION OF THE PREFERRED EMBODIMENTS

Reference will now be made in detail to the preferred embodiments, examples of which are illustrated in the accompanying drawings.

Figure 3:
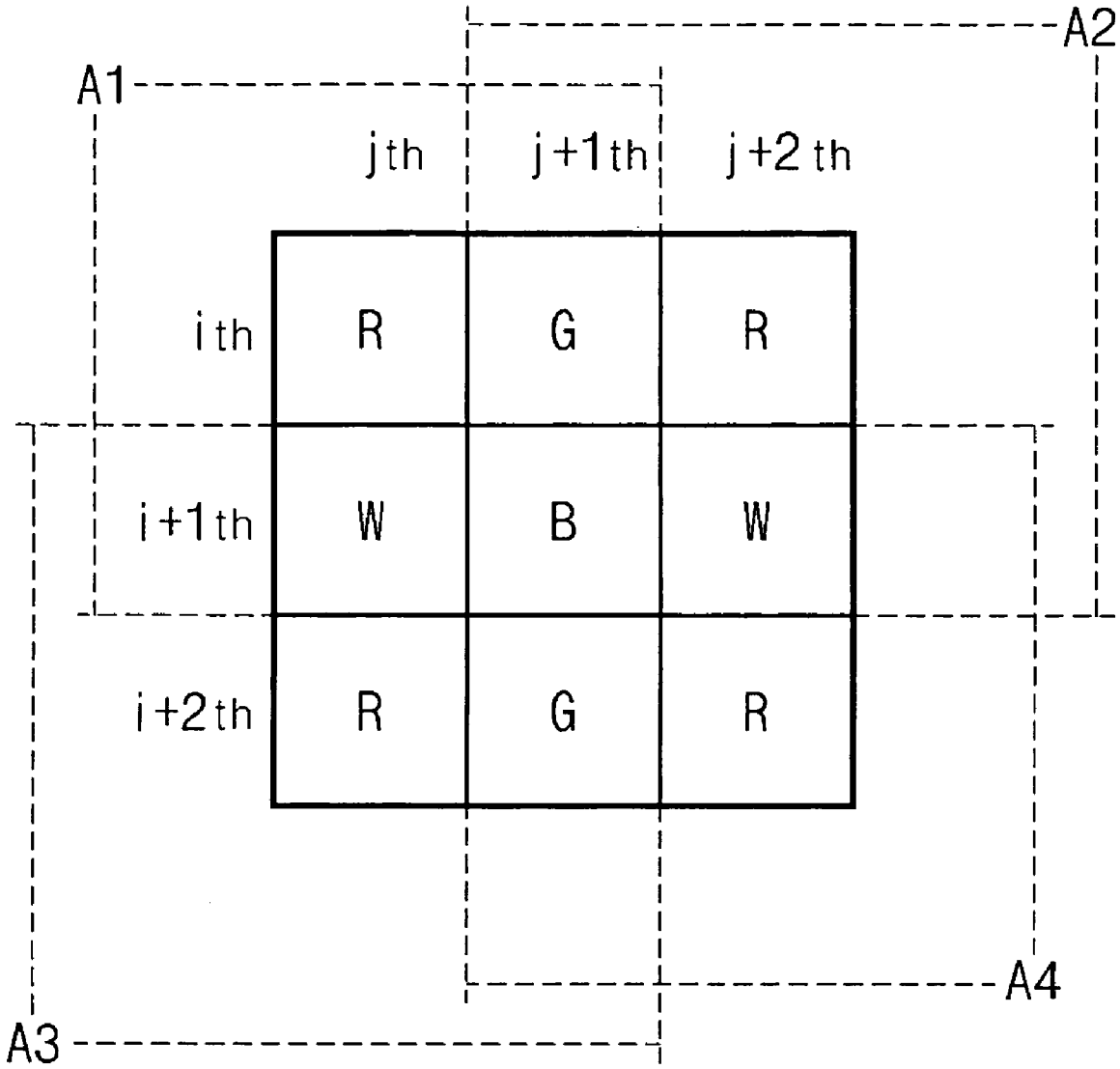
FIG. 3 is a view of a pixel arrangement according to an embodiment of the present invention.

FIG. 3 is a view of a pixel arrangement according to an embodiment of the present invention, and FIGS. 4A, 4B, 4C, and 4D are views of pixels defined in the pixel arrangement in FIG. 3. In FIG. 3, sub-pixels R, G, B, and W may be arranged in a 3×3 matrix having $i^{th}$ row, $i+1^{th}$ row, $i+2^{th}$ row, $j^{th}$ column, $j+1^{th}$ column, and $j+2^{th}$ column.

Figure 4A:
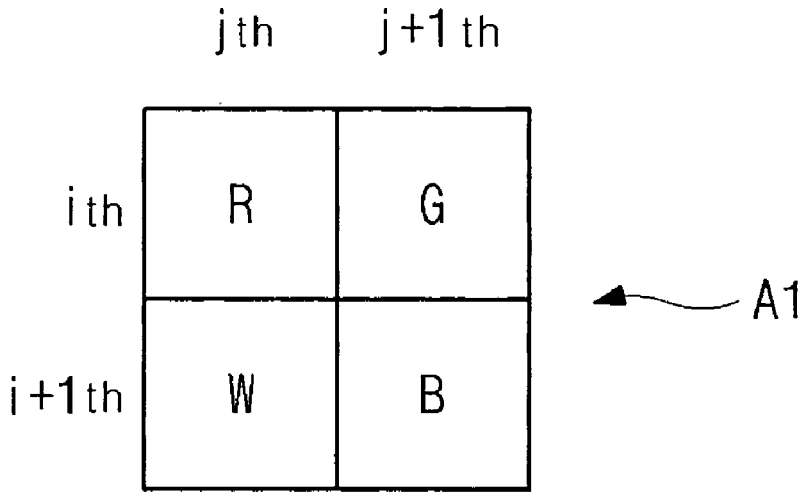
FIGS. 4A, 4B, 4C, and 4D are views of pixels defined in the pixel arrangement in FIG. 3.
Figure 4B:
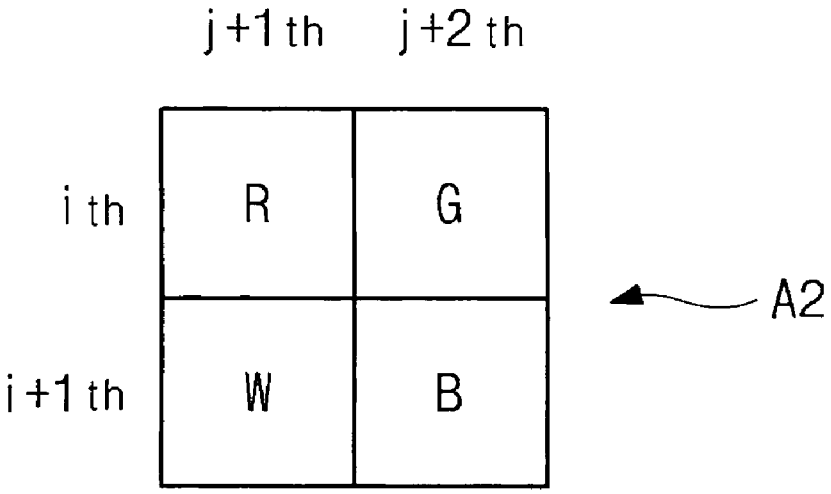
Figure 4C:
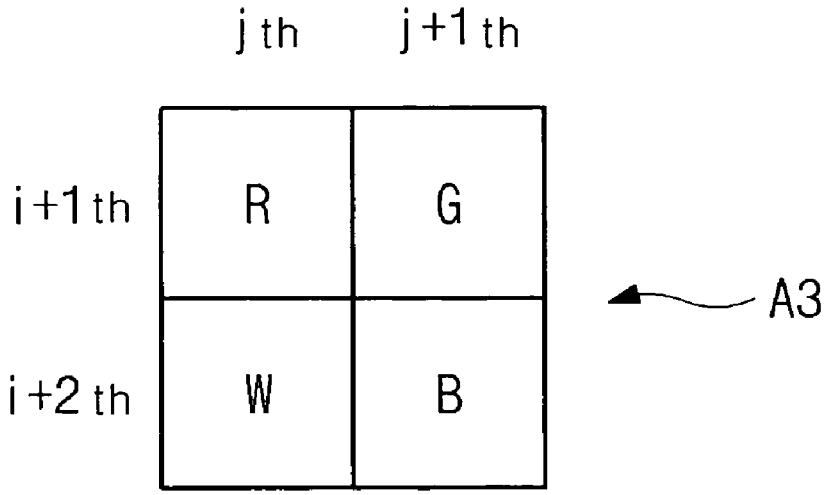
Figure 4D:
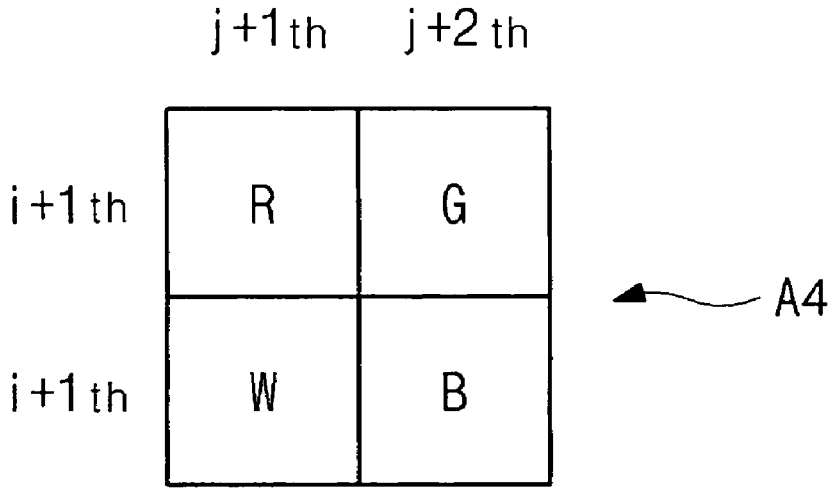

As shown in FIG. 4A, a first pixel A1 may be defined by the sub-pixels R, G, B, and W located, clock-wisely and respectively, at (i, j), (i, j+1), (i+1, j+1), and (i+1, j) of the 3×3 matrix. As shown in FIG. 4B, a second pixel A2 may be defined by the sub-pixels R, G, B, and W located, counter-clock-wisely and respectively, at (i, j+2), (i, j+1), (i+1, j+1), and (i+1, j+2) of the 3×3 matrix. In addition, as shown in FIG. 4C, a third pixel A3 may be defined by the sub-pixels R, G, B, and W located, counter-clock-wisely and respectively, at (i+2, j), (i+2, j+1), (i+1, j+1), and (i+1, j) of the 3×3 matrix. Further, as shown in FIG. 4D, a fourth pixel A4 may be defined by the sub-pixels R, G, B, and W located, clock-wisely and respectively, at (i+2, j+2), (i+2, j+1), (i+1, j+1), and (i+1, j+2) of the 3×3 matrix.

As shown in FIG. 3, the pixels A1 and A2 arranged along a row may share the sub-pixels G and B located, respectively, at (i, j+1) and (i+1, j+1) of the 3×3 matrix, and the pixels A3 and A4 also arranged along a row may share the sub-pixels B and G located, respectively, at (i+1, j+1) and (i+2, j+1) of the 3×3 matrix. In addition, the pixels A1 and A3 arranged along a column may share the sub-pixels W and B located, respectively, at (i+1, j) and (i+1, j+1) of the 3×3 matrix, and the pixels A2 and A4 also arranged along a column may share the sub-pixels B and W located, respectively, at (i+1, j+1) and (i+1, j+2) of the 3×3 matrix. In other words, the pixels A1 and A2 may share the $j+1^{th}$ column of the 3×3 matrix, and the pixels A3 and A4 may share the $j+1^{th}$ column of the 3×3 matrix. In addition, the pixels A1 and A3 may share the $i+1^{th}$ row of the 3×3 matrix, and the pixels A2 and A4 may share the $i+1^{th}$ row of the 3×3 matrix. Moreover, the pixels A1, A2, A3, and A4 may share the sub-pixel B located at (i+1, j+1) of the 3×3 matrix.

Accordingly, the above-mentioned adjacent pixels share sub-pixels arranged in a row or a column of the matrix. Therefore, the display device according to the embodiment of the present invention has fewer number of sub-pixels than the related art. For example, in case a display device having XGA resolution (1024×768), the display device according to the embodiment of the present invention may have sub-pixels arranged in a matrix having (1024+1) columns and (768+1) rows.

Figure 1:
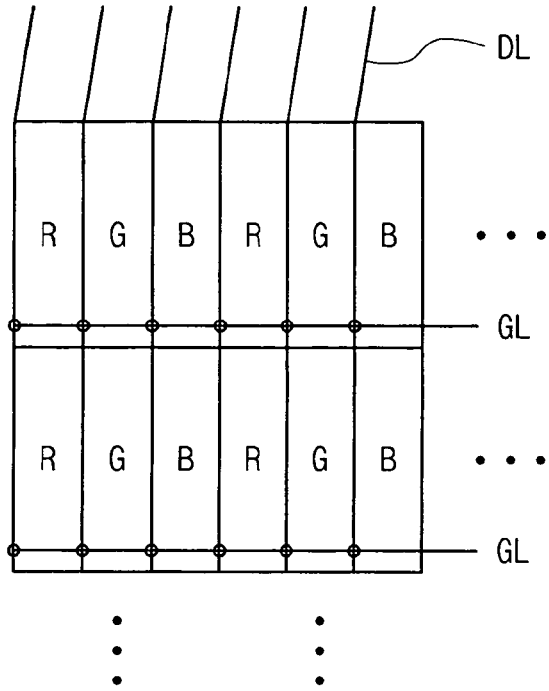
FIG. 1 RELATED ART
FIG. 1 is a view of a RGB-stripe-type display device according to the related art.
Figure 2:
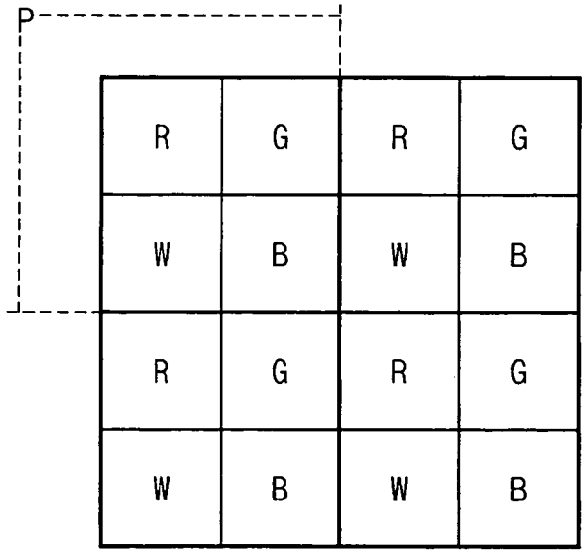
FIG. 2 RELATED ART
FIG. 2 is a view of a quad-type display device having red, green, blue, and white sub-pixels to the related art.

FIG. 5A is a view of a 9-pixel arrangement for the quad-type display device shown in FIG. 2 according to the related art. In FIG. 5A, a 9-pixel arrangement requires 36 sub-pixels to define nine pixels, each having sub-pixels R, G, B, and W, such that these pixels do not share sub-pixels with each other.

FIG. 5B is a view of a 9-pixel arrangement according to an embodiment of the present invention. As shown FIG. 5B, in contrast to FIG. 5A, a 9-pixel arrangement of the embodiment may have 16 sub-pixels defining nine pixels and adjacent pixels may share sub-pixels with each other. Therefore, R, G, B, and W input data signals may be converted into R', G', B', and W' shared data signals, which are supplied to R', G', B', and W' sub-pixels, respectively. For example, an R' shared data signal supplied to an R' sub-pixel disposed at (i, j) may have an average value of R input data signals supplied to R sub-pixels disposed at (i, j), (i, j+1), (i+1, j), (i+1, j+1) of the related art 9-pixel arrangement in FIG. 5A. Therefore, R', G', B', and W' shared data signals applied to, respectively, R' (i, j), G' (i, j), G' (i, j), and W' (i, j) of the 9-pixel arrangement of the embodiment may be expressed in terms of the input data signal applied to the related art 9-pixel arrangement in FIG. 5A as follows:

$$R'(i,j)=\{R(i,j)+R(i,j+1)+R(i+1,j)+R(i+1,j+1)\}/4$$

$$G'(i,j)=\{G(i,j)+G(i,j+1)+G(i+1,j)+G(i+1,j+1)\}/4$$

$$B'(i,j)=\{B(i,j)+B(i,j+1)+B(i+1,j)+B(i+1,j+1)\}/4$$

$$W'(i,j)=\{W(i,j)+W(i,j+1)+W(i+1,j)+W(i+1,j+1)\}/4.$$

Figure 6:
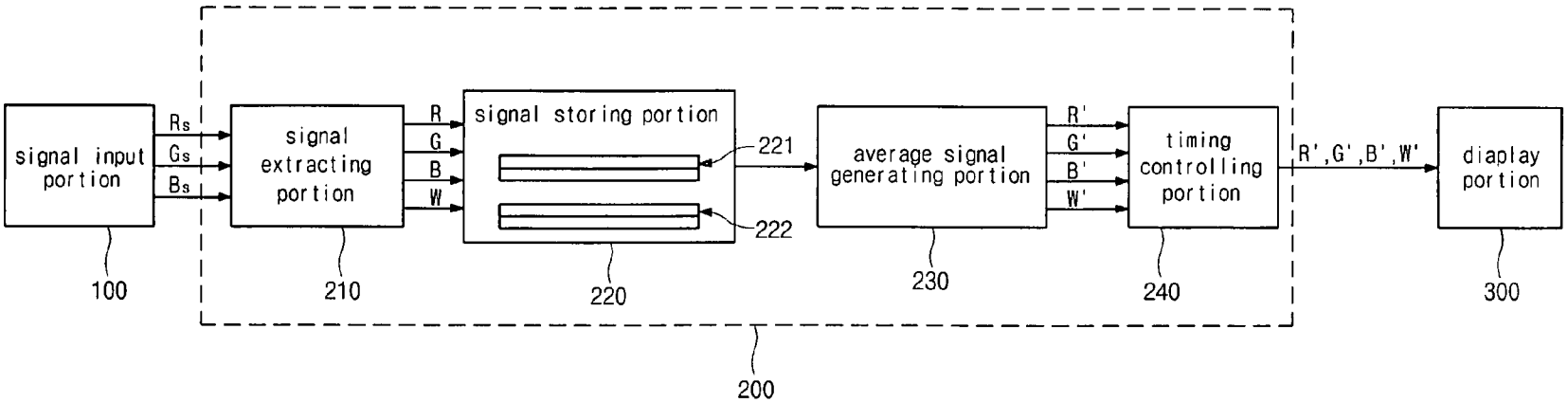
FIG. 6 is a view of a display device having a driving portion according to an embodiment of the present invention.

FIG. 6 is a view of a display device having a driving portion according to an embodiment of the present invention. In FIG. 6, a display device may include a signal input portion 100, a driving portion 200, and a display portion 300. The signal input portion 100 may supply source data signals Rs, Gs, and Bs to the driving portion 200. The driving portion 200 may include a signal extracting portion 210, a signal storing portion 220, an average signal generating portion 230, and a timing controlling portion 240. The signal extracting portion 210 may convert the source data signals Rs, Gs, and Bs received from the signal input portion 100 to input data signals R, G, B, and W. The signal storing portion 220 may then store the input data signals R, G, B, and W in first and second memories 221 and 222.

In addition, the average signal generating portion 230 may generate shared data signals R', G', B', and W' from the input data signals R, G, B, and W stored in the signal storing portion 220. For example, the shared data signal for the sub-pixel R' (i, 1) shown in FIG. 5B may be generated by averaging input data signals applied to the sub-pixels R(i, 1), R(i, 2), R(i+1, 1), and R(i+1, 2) shown in FIG. 5A. That is, the shared data signal may be generated by averaging input data signals adjacent to each other along a row and a column. Further, the shared data signals R', G', B', and W' may be supplied to the timing controlling portion 240, and the timing controlling portion 240 may output the shared data signals R', G', B', and W' to the display portion 300 according to a timing.

Figure 7:
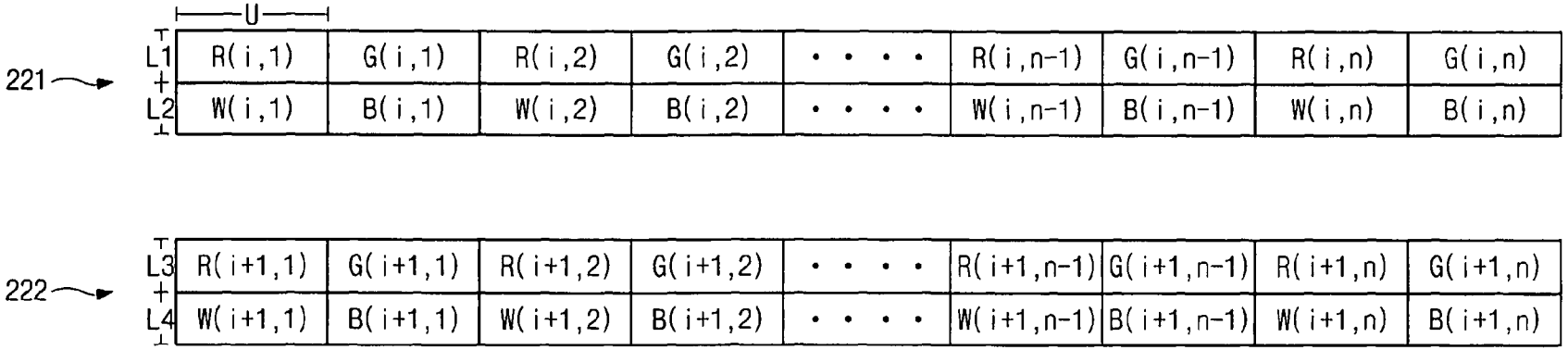
FIGS. 7 and 8 are views of the signal storing portion in the display device in FIG. 6.
Figure 8:
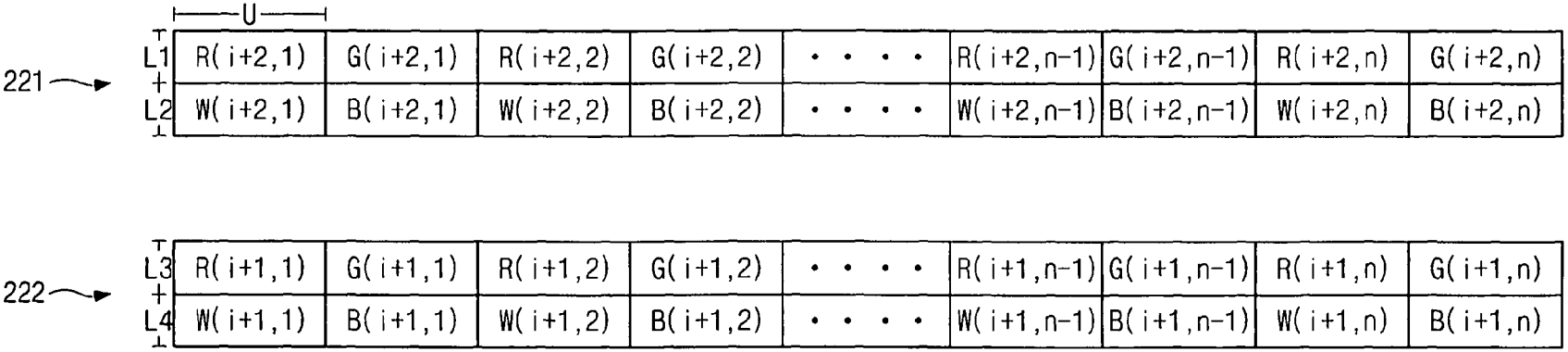

FIGS. 7 and 8 are views of the signal storing portion in the display device in FIG. 6. As shown in FIGS. 7 and 8, the first memory 221 may have first and second line-memories L1 and L2, and the second memory 222 may have third and fourth line-memories L3 and L4. If the display device has "n" horizontal resolution, the first, second, third, and fourth line-memories may have 2×n store-units "U", respectively. Each of the store-unit "U" may have a capacity corresponding to bits of the input data signals Rs, Gs and Bs. In case the display device has "m" vertical resolution, an "i" is a number selected of "m". The first and third line-memories L1 and L3 may store R and G input data signals, alternatively. The second and fourth line-memories L2 and L4 may store W and B input data signals, alternatively.

For example, in FIG. 7, the input data signals, R and G, corresponding to $i^{th}$ row of pixels in the pixel arrangement according to the related art shown in FIG. 5A, may be stored alternatively along the first line-memory L1. In addition, the input data signals, W and B, corresponding to $i^{th}$ row of pixels in the pixel arrangement according to the related art shown in FIG. 5A, may be stored alternatively along the second line-memory L2. Further, the input data signals, R and G, corresponding to $i+1^{th}$ row of pixels in the pixel arrangement according to the related art shown in FIG. 5A, may be stored alternatively along the third line-memory L3. In addition, the input data signals, W and B, corresponding to $i+1^{th}$ row of pixels in the pixel arrangement according to the related art shown in FIG. 5A, may be stored alternatively along the fourth line-memory L4.

Then, the averaging signal generating portion 230 shown in FIG. 6 may generate a shared data signal by averaging the input data signals stored in the line memories, L1, L2, L3, and L4. For example, the shared data signal for the sub-pixel R' (i, 1) shown in FIG. 5B may be generated by averaging input data signals stored in the store-units "U" in the first and third line memories L1 and L3 corresponding to R(i, 1), R(i, 2), R(i+1, 1), and R(i+1, 2) shown in FIG. 5A.

In FIG. 8, after R', G', B', and W' shared data signals corresponding to $i^{th}$ row of sub-pixels according to an embodiment of the present invention are generated, R, G, B, and W input data signals corresponding to $i+2^{th}$ row of pixels according to the related art may be stored in the first memory 221, while R, G, B, and W input data signals in the second memory 222 still are remained. R', G', B', and W' shared data signals corresponding to $i+1^{th}$ row of sub-pixels according to an embodiment of the present invention then may be generated from the first and second memories 221 and 222.

The display device of the above-discussed embodiments may have a plurality of pixels, adjacent pixels sharing sub-pixels and R', G', B', and W' shared data signals may be supplied to R, G, B, and W sub-pixels, respectively. The timing controlling portion 240 in FIG. 6 outputs R', G', B', and W' shared data signals to data driving integrated chips (not shown), which is connected with R', G', B', and W' sub-pixels through data lines. The number of sub-pixels in the display device according to the embodiments may be about a half of the number of sub-pixels in the display device according to the related art. Therefore, the number of data controlling ICs and data lines in the display device according to the embodiments may be about a half of the number of data controlling ICs and data lines in the display device according to the related art. In addition, the number of gate driving ICs and gate lines in the display device according to the embodiments may be about a half of the number of gate driving ICs and gate lines in the display device according to the related art.

Accordingly, the display device of the embodiments has a higher efficiency and an improved aperture ratio, since adjacent pixels share sub-pixels with each other and numbers of driving ICs, and gate and data lines are reduced.

It will be apparent to those skilled in the art that various modifications and variations can be made in the above-discussed display device and the driving method thereof without departing from the spirit or scope of the invention. Thus, it is intended that the present invention cover the modifications and variations of this invention provided they come within the scope of the appended claims and their equivalents.

What is claimed is:

1. A display device, comprising:

a signal storing portion storing first, second, third, and fourth input data signals;

an average signal generating portion averaging the first, second, third, and fourth input data signals, respectively, that are adjacent to each other along a row and a column and generating first, second, third, and fourth output data signals; and a display portion having a plurality of pixels, each of the pixels having first, second, third, and fourth sub-pixels for receiving the first, second, third, and fourth output data signals, respectively, each of the pixels sharing the sub-pixels with an adjacent one of the pixels, the first, second, third and fourth sub-pixels emitting red, green, blue and white, respectively, wherein the plurality of pixels includes $(i,j)^{th}$, $(i,j+1)^{th}$, $(i+1,j)^{th}$ and $(i+1,j+1)^{th}$ pixels adjacent to one another, wherein the first output data signal for the first sub-pixel of $(i,j)^{th}$ pixel is determined by averaging the first input data signals corresponding to the first sub-pixels of the $(i,j)^{th}$, $(i,j+1)^{th}$, $(i+1,j)^{th}$ and $(i+1,j+1)^{th}$ pixels, wherein the second output data signal for the second sub-pixel of $(i,j)^{th}$ pixel is determined by averaging the second input data signals corresponding to the second sub-pixels of the $(i,j)^{th}$, $(i,j+1)^{th}$, $(i+1,j)^{th}$ and $(i+1,j+1)^{th}$ pixels, wherein the third output data signal for the third sub-pixel of $(i,j)^{th}$ pixel is determined by averaging the third input data signals corresponding to the third sub-pixels of the $(i,j)^{th}$, $(i,j+1)^{th}$, $(i+1,j)^{th}$ and $(i+1,j+1)^{th}$ pixels, and wherein the fourth output data signal for the fourth sub-pixel of $(i,j)^{th}$ pixel is determined by averaging the fourth input data signals corresponding to the fourth sub-pixels of the $(i,j)^{th}$, $(i, j+1)^{th}$, $(i+1,j)^{th}$ and $(i+1,j+1)^{th}$ pixels.

2. The display device according to claim 1, wherein the first, second, third, and fourth sub-pixels are arranged in a matrix form having two rows and two columns.

3. The display device according to claim 2, wherein the adjacent pixels along a row share the sub-pixels disposed in a column, and the adjacent pixels along a column share the sub-pixels disposed in a row.

4. The display device according to claim 3, wherein the signal storing portion comprises a first memory including first and second line-memories.

5. The display device according to claim 4, wherein the first and third input data signals for a first set of the pixels are stored alternatively in the first line-memory, and the second and fourth input data signals for the first set of the pixels are stored alternatively in the second line-memory.

6. The display device according to claim 5, wherein the signal storing portion further comprises a second memory including third and fourth line-memories.

7. The display device according to claim 6, wherein the first and third input data signals for a second set of the pixels are stored alternatively in the third line-memory, and the second and fourth input data signals for the second set of the pixels are stored alternatively in the fourth line-memory.

8. The display device according to claim 1, further comprises a signal extracting portion converting a first, second, and third source data signals to the first, second, third, and fourth input data signals.

9. The display device according to claim 1, wherein the first sub-pixel emitting red is arranged at (1, 1) position in the $(i,j)^{th}$ pixel, at (1, 2) position in the $(i, j+1)^{th}$ pixel, at (2, 1) position in the $(i+,j)^{th}$ pixel, at (2, 2) position in the $(i+1,j+1)^{th}$ pixel, the second sub-pixel emitting green is arranged at (1, 2) position in the $(i,j)^{th}$ pixel, at (1, 1) position in the $(i,j+1)^{th}$ pixel, at (2, 2) position in the $(i+,j)^{th}$ pixel, at (2, 1) position in the $(i+1,j+1)^{th}$ pixel, the third sub-pixel emitting blue is arranged at (2, 2) position in the $(i,j)^{th}$ pixel, at (2, 1) position in the $(i,j+1)^{th}$ pixel, at (1, 2) position in the $(i+,j)^{th}$ pixel, at (1, 1) position in the $(i+1, j+1)^{th}$ pixel, and the fourth sub-pixel emitting white is arranged at (2, 1) position in the $(i,j)^{th}$ pixel, at (2, 2) position in the $(i,j+1)^{th}$ pixel, at (1, 1) position in the $(i+,j)^{th}$ pixel, at (1, 2) position in the $(i+1,j+1)^{th}$ pixel.

10. A driving method of a display device, comprising:

storing first, second, third, and fourth input data signals;

averaging the first, second, third, and fourth input data signals, respectively, that are adjacent to each other along a row and a column, and generating first, second, third, and fourth output data signals; and displaying images through a plurality of pixels, each of the pixels having first, second, third, and fourth sub-pixels for receiving the first, second, third, and fourth output data signals, respectively, each of the pixels sharing the sub-pixels with an adjacent one of the pixels, the first, second, third and fourth sub-pixels emitting red, green, blue and white, respectively, wherein the plurality of pixels includes $(i,j)^{th}$, $(i,j+1)^{th}$, $(i+1,j)^{th}$ and $(i+1,j+1)^{th}$ pixels adjacent to one another, wherein the first output data signal for the first sub-pixel of $(i,j)^{th}$ pixel is determined by averaging the first input data signals corresponding to the first sub-pixels of the $(i,j)^{th}$, $(i,j+1)^{th}$, $(i+1,j)^{th}$ and $(i+1,j+1)^{th}$ pixels, wherein the second output data signal for the second sub-pixel of $(i,j)^{th}$ pixel is determined by averaging the second input data signals corresponding to the second sub-pixels of the $(i,j)^{th}$, $(i,j+1)^{th}$, $(i+1,j)^{th}$ and $(i+1,j+1)^{th}$ pixels, wherein the third output data signal for the third sub-pixel of $(i,j)^{th}$ pixel is determined by averaging the third input data signals corresponding to the third sub-pixels of the $(i,j)^{th}$, $(i,j+1)^{th}$, $(i+1,j)^{th}$ and $(i+1,j+1)^{th}$ pixels, and wherein the fourth output data signal for the fourth sub-pixel of $(i,j)^{th}$ pixel is determined by averaging the fourth input data signals corresponding to the fourth sub-pixels of the $(i,j)^{th}$, $(i, j+1)^{th}$, $(i+1,j)^{th}$ and $(i+1,j+1)^{th}$ pixels.

11. The driving method according to claim 10, wherein the first, second, third, and fourth sub-pixels are arranged in a matrix form having two rows and two columns.

12. The driving method according to claim 11, wherein the adjacent pixels along a row share the sub-pixels disposed in a column, and the adjacent pixels along a column share the sub-pixels disposed in a row line.

13. The driving method according to claim 12, wherein storing the first, second, third, and fourth input data signals comprises storing the first and third input data signals for a first set of the pixels alternatively in a first line-memory, and storing the second and fourth input data signals for the first set of the pixels alternatively in a second line-memory.

14. The driving method according to claim 13, wherein storing the first, second, third, and fourth input data signals further comprises storing the first and third input data signals for a second set of the pixels alternatively in a third line-memory, and storing the second and fourth input data signals for the second set of the pixels alternatively in a fourth line -memory.

15. The driving method according to claim 10, further comprising converting first, second, and third source data signals to the first, second, third, and fourth input data signals.

16. The driving method according to claim 10, wherein the first sub-pixel emitting red is arranged at (1, 1) position in the $(i,j)^{th}$ pixel, at (1, 2) position in the $(i, j+1)^{th}$ pixel, at (2, 1) position in the $(i+,j)^{th}$ pixel, at (2, 2) position in the $(i+1,j+1)^{th}$ pixel, the second sub-pixel emitting green is arranged at (1, 2) position in the $(i,j)^{th}$ pixel, at (1, 1) position in the $(i,j+1)^{th}$ pixel, at (2, 2) position in the $(i+,j)^{th}$ pixel, at (2, 1) position in the $(i+1,j+1)^{th}$ pixel, the third sub-pixel emitting blue is arranged at (2, 2) position in the $(i,j)^{th}$ pixel, at (2, 1) position in the $(i,j+1)^{th}$ pixel, at (1, 2) position in the $(i+,j)^{th}$ pixel, at (1, 1) position in the $(i+1, j+1)^{th}$ pixel, and the fourth sub-pixel emitting white is arranged at (2, 1) position in the $(i,j)^{th}$ pixel, at (2, 2) position in the $(i,j+1)^{th}$ pixel, at (1, 1) position in the $(i+,j)^{th}$ pixel, at (1, 2) position in the $(i+1,j+1)^{th}$ pixel.

* * * * *